US005462459A

United States Patent [19]

Childs

[11] Patent Number: 5,462,459

[45] Date of Patent: Oct. 31, 1995

[54] SPRING-TYPE ELECTRICAL RECEPTACLE

[75] Inventor: Jonathan Childs, Rochester, Mich.

[73] Assignee: Cardell Corporation, Rochester Hills, Mich.

[21] Appl. No.: 312,967

[22] Filed: Sep. 30, 1994

[51] Int. Cl.[6] ..... H01R 13/11

[52] U.S. Cl. ..... 439/843; 439/856

[58] Field of Search ..... 439/851–856, 439/861, 857, 842–844

[56] References Cited

U.S. PATENT DOCUMENTS

| | | | |
|---|---|---|---|
| 3,995,869 | 12/1976 | Mazingue | 279/33 |
| 4,283,108 | 8/1981 | Fischer | 439/857 |
| 4,720,276 | 1/1988 | Takahashi | 439/861 |
| 4,734,064 | 3/1988 | Knapp et al. | 439/852 |
| 4,778,231 | 10/1988 | Seidler et al. | 439/857 |
| 4,795,379 | 1/1989 | Sasaki et al. | 439/856 |
| 4,834,681 | 5/1989 | Chaillot | 439/856 |
| 4,919,628 | 4/1990 | Mobley et al. | 439/858 |
| 5,186,663 | 2/1993 | Wymelenberg | 439/843 |
| 5,295,875 | 3/1994 | McCardell | 439/851 |

FOREIGN PATENT DOCUMENTS

| | | | |
|---|---|---|---|
| 2627020 | 2/1988 | France | 439/843 |
| 3291874 | 4/1990 | Japan | 439/843 |

*Primary Examiner*—Gary F. Paumen
*Assistant Examiner*—Jill DeMello
*Attorney, Agent, or Firm*—Jones, Tullar & Cooper

[57] ABSTRACT

An electrical connector having a spring-arm receptacle is surrounded by a hood which is rectangular in cross-section. The hood guides a plug-type terminal tip into the receptacle. The receptacle includes at least one spring arm which is generally convex and defines transverse contact lines which engage opposite surfaces of the terminal tip when it engages the receptacle. At least one arm includes a central portion between the transverse contact lines, which forms a concave spring upon deflection.

16 Claims, 4 Drawing Sheets

FIG. 4
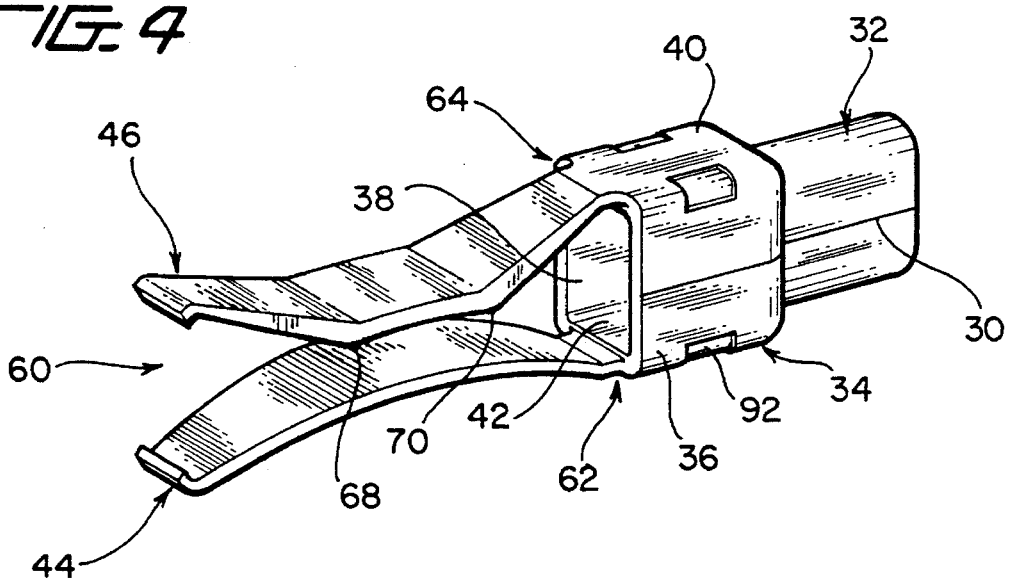
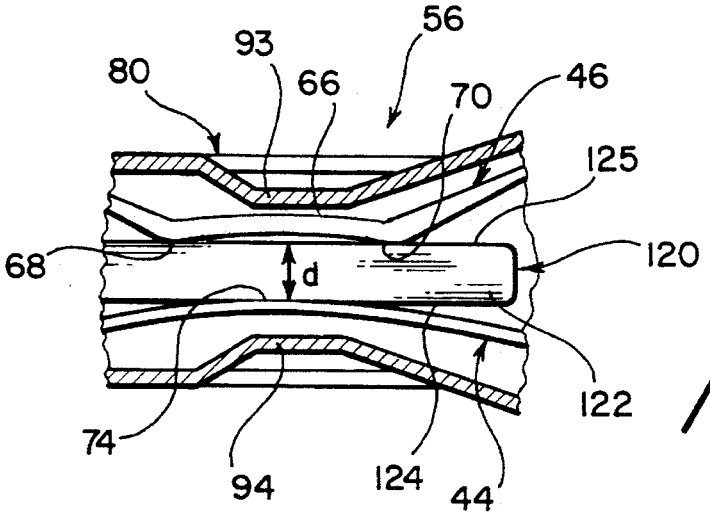
FIG. 5
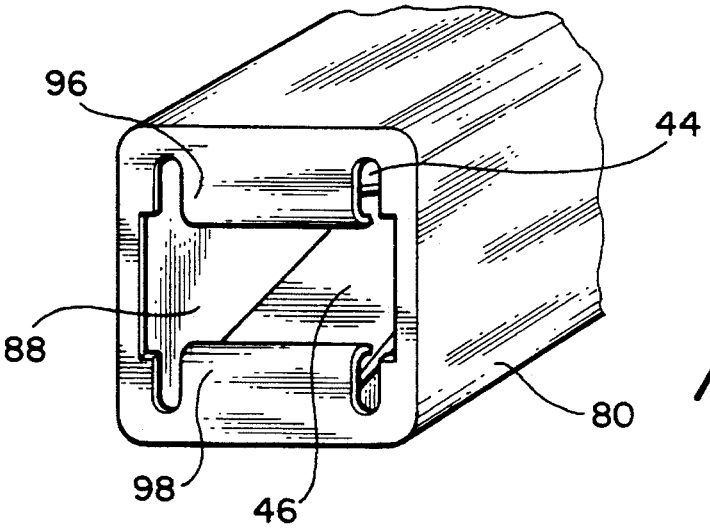
FIG. 6

SPRING-TYPE ELECTRICAL RECEPTACLE

BACKGROUND OF THE INVENTION

The present application relates, in general, to electrical connectors, and more particularly to an improved spring-arm receptacle shaped to receive male terminals, and to provide improved contact therebetween.

Pin and blade-type male terminals for electrical connectors are well known and are widely used in a variety of applications. As is known, a problem with such terminals is to ensure a reliable, low-resistance connection between the terminal and a corresponding receptacle, or socket. Uniform forces are important for this purpose, since such connectors may be subject to vibration or to a rocking motion of the terminal which may tend to loosen the connection and cause arcing or fretting corrosion. Such problems occur particularly in connector structures where there is only a single point of contact between the terminal and the receptacle, as is often the case, and lead to increased resistance and consequent heating of the connection, often resulting in open circuits or, in high power applications, in welding the connector together, thereby preventing disassembly.

Many connector receptacles, or sockets, utilize spring-like tines, or flexible spring arms, which typically provide a pair of opposed spring contacts which are spaced apart to receive a male terminal. However, if a terminal is inserted at an angle, for example, or if a terminal that is too large for the connector or is the wrong shape is inserted, permanent deformation of the spring contacts can occur due to over-extension of the metal, with consequent loss of contact integrity. This often results in the above-noted fretting corrosion, which causes the resistance of the connector to increase, resulting in heating which further reduces the strength of the contact and causes rapid deterioration of the connection.

SUMMARY OF THE INVENTION

It is an object of the present invention to provide a electrical connector including a first socket-type terminal, or receptacle, for receiving a second plug-type or tab terminal, wherein the receptacle includes a resilient contact arm, which is shaped to provide contact integrity and the plug includes an elongated tip which is shaped to fit into the receptacle and engage the resilient arm.

It is another object of the invention to provide an electrical receptacle for plug-type terminals having a blade contact, the receptacle having at least one spring-type contact arm which is shaped to provide lines of contact on the blade for securing it and for ensuring continuous contact.

Another object of the invention is to provide a receptacle for a male terminal wherein the receptacle has opposed spring-type contact arms, which provide a three-line contact with the terminal.

Another object of the invention is to provide an electrical receptacle having flexible spring-type arms and incorporating limit tabs to prevent stressing of the arms during insertion of male terminals or during use of the connector.

Another object of the invention is to provide an electrical receptacle having a surrounding hood for guiding a terminal into the receptacle and for preventing stressing of receptacle spring contact arms.

Another object of the invention is to provide an electrical receptacle having flexible spring-type contacts for receiving a blade terminal, the receptacle incorporating a surrounding hood for protecting the contacts and for guiding the blade terminal into the receptacle, and further incorporating limit tabs adjacent the contacts for preventing overstressing during use of the connector.

Briefly, the present invention is directed, in one embodiment, to an improved electrical connector having a spring-type receptacle for receiving a thin, elongated plug-type electrical terminal such as a flat blade terminal. The receptacle in a preferred form of the invention, incorporates a pair of wide, elongated, opposed spring arms which are spaced apart on opposite sides of a longitudinal receptacle axis to receive the blade terminal and which provide longitudinally spaced, laterally extending contact lines for electrically contacting opposite sides of the blade terminal. The spring arms are cantilevered and are shaped, as by coining, to produce elongated, longitudinally generally convex, opposed leaf springs having contact regions for receiving and mechanically contacting the blade terminal for electrical connection between the receptacle and the terminal. Each contact region incorporates at least one line of contact which extends in a direction perpendicular to the longitudinal axes of the spring arms and thus extend across the width of the received blade.

The plug-type terminal part of the connector can take many forms, but preferably includes a thin, elongated metal tip secured in a sheet metal body. The tip is fabricated, for example, from a solid metal wire having a circular cross-section, and in one form the wire may be shaped, as by stamping or coining to a desired width and thickness along a forward portion of its length to form a flat, blade-like terminal. The rearward portion, or near end, of the wire may remain round, and is secured in a forward portion of the sheet metal body by precision forming a stamped sheet metal body around the rearward end of the wire. If desired, the wire may be secured in the body portion by solder. The rearward end of the terminal sheet metal body portion is shaped to receive and grip both the bare metal conductors and the surrounding insulation of a wire or cable, in well-known manner. The shaped wire and body portion constitute a plug-type terminal for an electrical connector, with the tip portion preferably in the form of a blade which is wider than it is thick, with flat upper and lower parallel surfaces for engaging corresponding contact arms in a receptacle. It will be understood that the blade portion can be shaped either before or after the wire is secured in the sheet metal body portion.

In a preferred form of the invention, the receptacle part of the connector includes two opposed, parallel sheet metal spring arms which are unitary with, and which extend forwardly in cantilever fashion from a sheet metal body portion. The arms are on opposite sides of, and are generally parallel to, a longitudinal axis of the receptacle. The body portion preferably is generally rectangular in cross section at its forward end, having top, bottom, and first and second side walls surrounding the receptacle longitudinal axis, with the first and second spring arms extending forwardly from, and being formed as part of, the first and second side walls, respectively. The spring arms are elongated, have widths greater than their thicknesses, are flexible and resilient, and extend in parallel spaced relationship on opposite sides of the longitudinal axis of the body to define a receiver for the blade terminal discussed above. In this preferred embodiment, the first spring arm has a substantially continuous convex curvature from its base at the body portion forwardly to its free end. The arm initially curves inwardly toward a contact region adjacent the axis and then curves outwardly away from the axis. The curvature is uniform across the width of the arm so as to provide a transverse, straight line of contact with a flat blade surface at the contact region of the curvature. The contact line is at the closest point of the arm to the axis, about midway along its length. When a flat blade terminal is inserted into the receptacle colinearly with the axis, one surface of the blade will contact the curved spring arm tangentially at the transverse line of contact. If the blade is inserted at an angle with respect to the axis, the contact line may shift forwardly within the contact region toward the free end or rearwardly within the contact region toward the body portion of the receptacle, but the transverse line of contact is maintained.

The second spring arm, which is also generally convex, extends forwardly from its base at the body portion to a free end. In a first region the second arm extends generally inwardly from its base at the body portion toward the axis, extends in a second central region generally parallel to the axis, and in a third region extends outwardly from the axis to its free end. However, the second spring arm differs from the first spring arm in that it is not necessarily continuously curved. Although generally convex, it preferably is shaped, preferably by coining, to produce in the first generally inwardly extending region a linear flat segment, to produce in the second, or region a widened, thinned, flat segment, and to produce in the third region a generally outwardly extending linear flat segment. The coining operation produces transverse ridges at the junctures between the three segments by thinning the metal in the central segment to a greater extent than at the first and third segments to widen that central segment and to produce bending discontinuities at the ridges between the central and the adjoining segments. The transverse ridges so produced are spaced apart along the length of the second spring arm so as to straddle the tangential contact line of the first spring arm.

Upon insertion of a blade terminal into the receptacle, the second spring arm contacts a corresponding second flat surface of the blade at the transverse ridges spaced on opposite sides of the transverse line of contact between the blade and the first spring arm. This produces a three-line contact arrangement between the receptacle spring arms and the blade to provide an improved electrical connection. The blade terminal forces the ridges in the second spring arm outwardly and because one end of the arm is fixed and the other, free, end of the arm is restrained by a hood (to be described), the outward force causes the central segment of that arm to flex or bow outwardly. This outward concave curvature acts as a spring to force the blade terminal against the transverse line of contact provided by the convex curvature of the first spring arm to thereby secure the blade firmly in place and to stabilize it, even when it is subjected to vibration. This structure provides lines of contact between the receptacle and the terminal at repeatable, known locations whenever the blade (or other terminal tip) is inserted into the receptacle.

The spring arms are preferably wider than the blade and are close together to provide a generally rectangular aperture between them, as viewed from the end of the receptacle, into which the blade or other terminal tip is inserted. The aperture is slightly wider than the blade by reason of the width of the spring arms, while the height of the aperture is preferably less than the thickness of the blade so that when the blade is inserted longitudinally into the receptacle, the spring arms are forced apart, while the concave central segment of the second arm holds the two spaced ridges in contact with the corresponding surface of the blade and holds the blade against the curved first arm.

The coining of the second spring arm in its central region thins the metal and produces increased flexibility between the two transverse ridges at the ends of the central segment to provide improved spring action of the arm to hold the ridges in contact with the surface of a blade when it is inserted into the receptacle. This improved flexibility and holding power is obtained by reducing the thickness of the sheet metal by between 20% and 40% with respect to the thickness of the sheet metal of the remainder of the spring arm, in the preferred form of the invention, and improves the electrical connection without significant weakening of the spring arm.

In an alternative form of the invention, the first spring arm may be fabricated in the manner described for the second spring arm, to thereby provide a mirror image thereof. This results in four transverse contact lines for electrical connection between the receptacle and a blade, two on one arm and two on the other. The contact lines may be opposite each other or offset from each other, as desired.

To insure that the spring arms are not overstressed, and to produce the curvature between the transverse ridges discussed above when a terminal is inserted into the receptacle and to align the blade or other terminal tip with the axis of the receptacle to keep it centered between the spring arms, a hood is secured at its rearward end to the receptacle body and extends forwardly with its forward free end surrounding the forwardly-extending cantilevered spring arms. The hood may be secured to the body by crimping, for example, with the forwardly-facing free end of the hood being open to define a central aperture for receiving and aligning the blade. Preferably, the hood is rectangular in cross section, as viewed from its end, to fit closely around the exterior of the body portion and the spring arms. Midway along the length of the hood, inwardly extending tabs are formed to provide stops for the spring arms to prevent excessive outward motion and consequent overstressing of the metal upon insertion of an oversized blade. The forward end of the hood engages the free ends of the cantilevered spring arms to restrain them as a terminal is inserted into the receptacle, causing the force of the terminal on the contact ridges to produce a concave bowing of the second spring arm. This structure provides improved connection with the blade, securing the blade in the receptacle and reducing the likelihood of fretting.

For clarity, the invention will be described hereinafter in terms of a receptacle for blade-type male terminals but it will be understood that the receptacle is also suitable for pin-type terminals as well as terminals having elongated tips with other cross-sectional shapes, and will provide the spaced transverse line contacts with such terminals, as described above.

BRIEF DESCRIPTION OF THE DRAWINGS

The foregoing and additional objects, features, and advantages of the present invention will become apparent to those of skill in the art from a consideration of the following detailed description of a preferred embodiment thereof, taken in conjunction with the accompanying drawings, in which.

Figure 1:
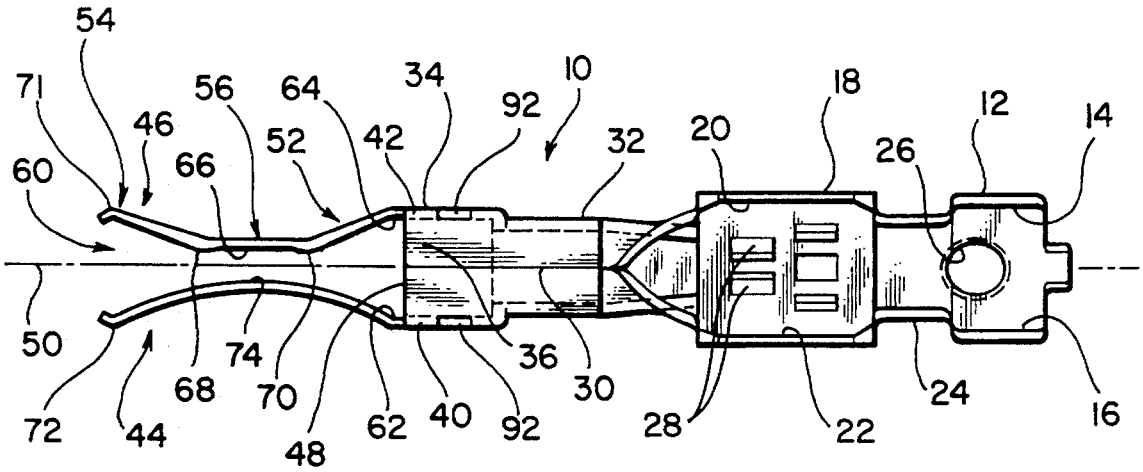
FIG. 1 is a top plan view of an electrical connector receptacle terminal for receiving plug-type terminals and illustrating a first embodiment of spring-type receptacle arms.
Figure 3:
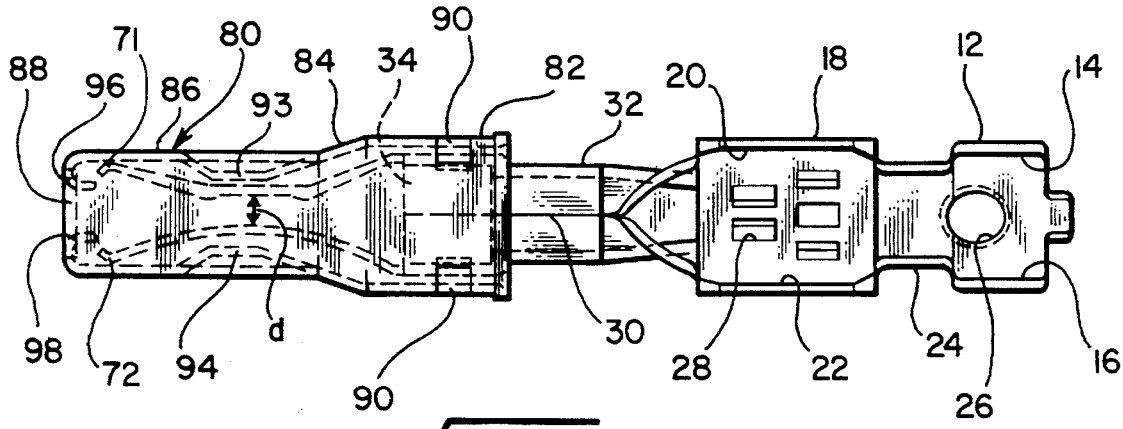
FIG. 3 is a top plan view of the receptacle of FIG. 1 further incorporating a protective hood.
Figure 7:
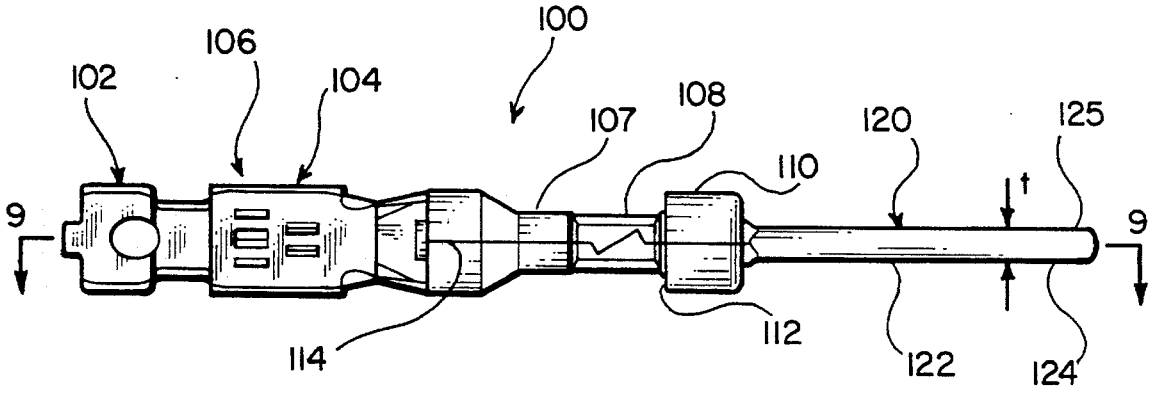
Figure 8:
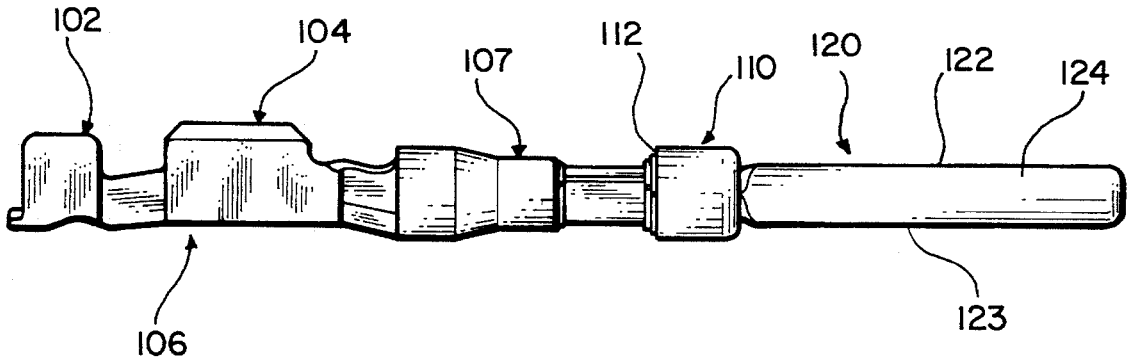
Figure 9:
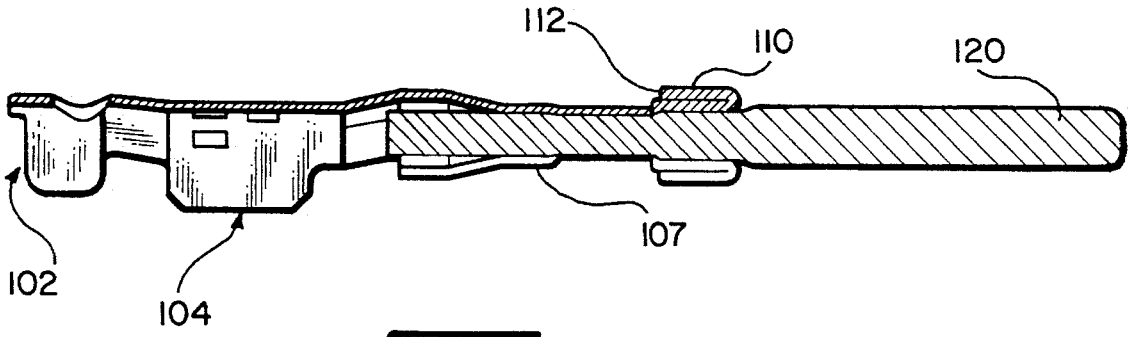
Figure 10:
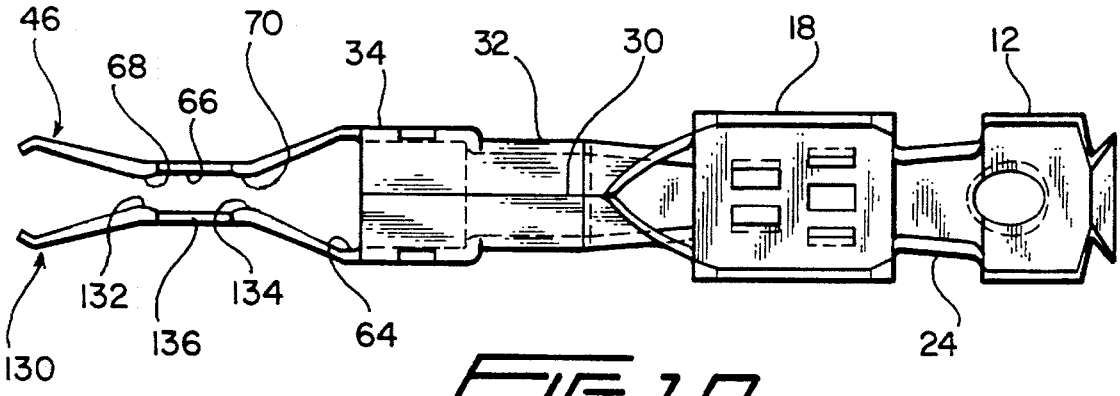
Figure 11:
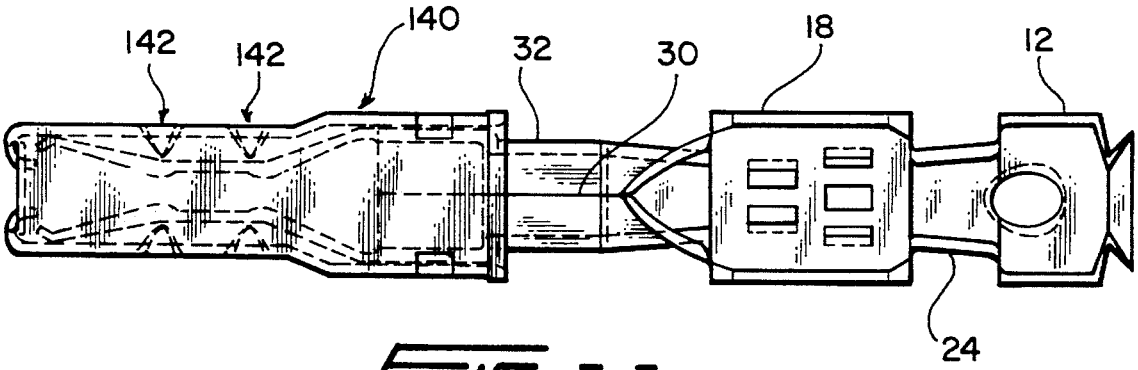
Figure 12:
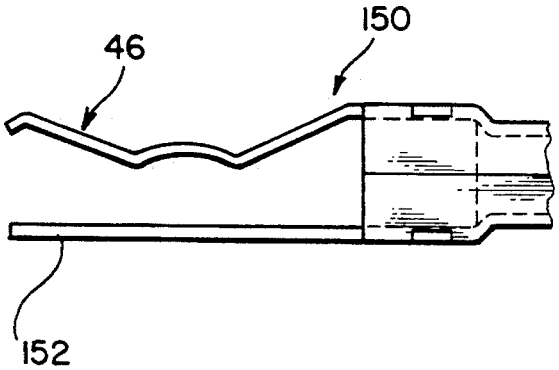

FIG. 4 is a perspective view of a portion of the receptacle of FIG. 1;

FIG. 5 is an enlarged view of a portion of the receptacle and hood of FIG. 3 with the hood partially removed, and with a terminal blade inserted therein;

FIG. 6 is an enlarged perspective end view of the hood of FIG. 3;

FIG. 7 is a top plan view of a blade-type terminal for use with the receptacle of FIG. 1;

FIG. 8 is a side elevation view of the terminal of FIG. 5;

FIG. 9 is a cross-sectional view of the terminal of FIG. 5 taken along lines 9—9 thereof;

FIG. 10 is a top plan view of a modified form of the receptacle of FIG. 1;

FIG. 11 is a top plan view of the embodiment of FIG. 10, incorporating a protective hood;

FIG. 12 is a top plan view of another form of the receptacle of FIG. 1; and

Figure 13:
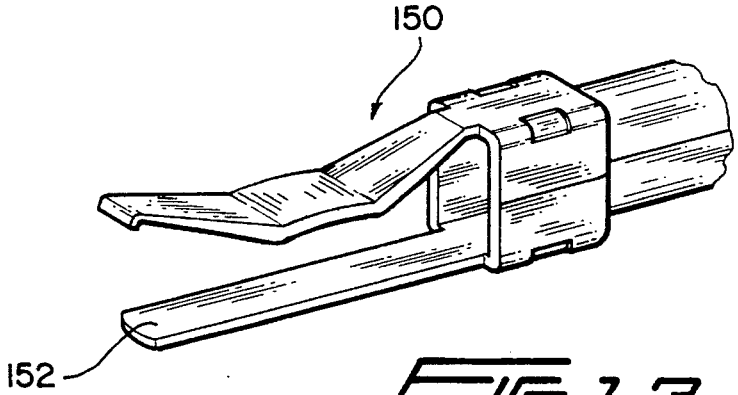

FIG. 13 is a perspective view of the embodiment of FIG. 12.

DESCRIPTION OF PREFERRED EMBODIMENT

Figure 2:
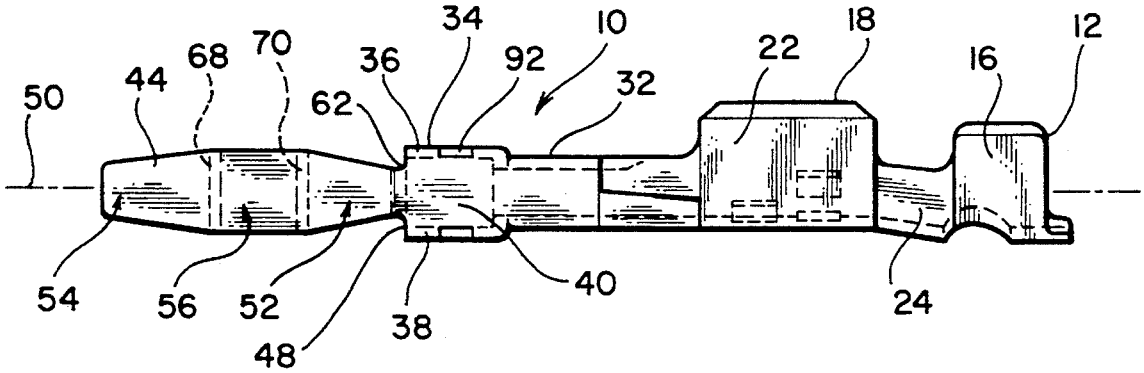
FIG. 2 is a side elevation view of the receptacle of FIG. 1.

Turning now to a more detailed description of the present invention, there is illustrated in FIGS. 1 and 2 a receptacle 10 for an electrical connector in accordance with the present invention. The receptacle is stamped and then precision formed from a single sheet metal piece. A first crimping portion 12 is, as illustrated, generally U-shaped and incorporates a pair of upstanding arms 14 and 16 which are capable of surrounding and being crimped onto the insulating cover of an electrical connector wire or cable (not shown) to secure the receptacle 10 thereto for providing a termination for the wire. The receptacle 10 further includes a second crimping portion 18 which is generally U-shaped in cross section and which includes a pair of upstanding arms 20 and 22 which may be crimped around and onto wire strands of the cable which the receptacle 10 terminates to thereby provide electrical connection between the wire and the sheet metal of the receptacle. The crimping portions 12 and 18 are joined by a generally U-shaped body portion 24 for receiving the cable. If desired, the crimping portion 12 may incorporate an aperture 26 to aid in gripping the cable. Gripping tabs 28 may also be provided in the crimping portion 18, as is conventional.

Forwardly of the second crimping portion 18, the sheet metal is precision formed to bring its outermost edges together at junction 30 to form a generally cylindrical intermediate body portion 32 and to form a generally rectangular forward body portion 34, as most clearly illustrated in FIG. 4. The body portion 34 includes top and bottom walls 36 and 38 respectively, as illustrated in FIGS. 2 and 4, and first and second side walls 40 and 42, illustrated in FIGS. 1 and 4. The side walls 40 and 42 extend forwardly beyond the body portion 34 to form a corresponding pair of opposed, generally parallel, spaced spring arms 44 and 46. The spring arms are integral with, and are cantilevered from, the forward edge 48 of the body portion 34 and are spaced on opposite sides of a longitudinal axis 50 of the receptacle 10. As most clearly illustrated with respect to arm 44 in FIGS. 1 and 2, the two spring arms are generally convex; that is, they extend forwardly and are curved inwardly toward the axis 50 and then outwardly, with the arms each being relatively narrow at the rearward and forward ends 52 and 54, and being relatively wide at a central region 56. The spaced spring arms define a central aperture 60 which receives a terminal tip, to be described.

As discussed above, the receptacle 10 is fabricated from a single sheet of metal and is precision formed to produce the crimping portion 12, the U-shaped body portion 24, the crimping portion 18, the intermediate body portion 32, and the forward body portion 34. The precision forming of the sheet metal serves to fold the side walls 40 and 42 upwardly to bring the spring arms 44 and 46 into parallel opposed relationship on opposite sides of the axis 50. Before the precision forming step, however, the spring arms 44 and 46 are shaped, as by coining, to produce the shapes illustrated in FIGS. 1 and 4. The coining operation bends the metal of the spring arms at their junctures with the side walls 40 and 42, as illustrated at 62 and 64, respectively, to form spring hinges where the arms 44 and 46 join the body portion 34.

Arm 46 is also widened and thinned by the coining operation to produce the widened segment 66 in its central portion 56. This coining forms two inwardly-facing ribs 68 and 70 extending transversely across the width of spring arm 46 to effectively divide the spring arm into forward, central and rearward segments corresponding to the regions 54, 56, and 52. As illustrated, then, the coining operation produces in the spring arm 46 a thinned region, or hinge 64, a generally flat rearward segment 52, a thin, flat middle segment 56, and a flat, outwardly directed forward segment 54 terminating in free end 71. The metal of spring arm 46 is coined to a thickness that is slightly less than that of the sheet metal used to form the remainder of the receptacle, while the central segment 56 is made even thinner, reducing the thickness at this segment to 20% to 40% less than the remaining metal of the spring arm. This coining operation provides additional flexibility to the spring arm 46, and particularly to segment 56, so that it will accommodate different thicknesses, shapes, and angles of insertion of terminal tips while still maintaining contact at the transverse contact lines defined by ribs 68 and 70.

Spring arm 44, in the preferred form of the invention, is also coined from the sheet metal to produce a thinned hinge region 62 and a continuous, constant-radius convex curve from the hinge region forwardly and inwardly to a point near axis 50, and then forwardly and outwardly away from axis 50 to the free end thereof generally indicated at 72. The spring arm 44 thus has its nearest approach to the central axis 50 in the central region 56 at a transverse line at 74 extending across the width of the arm. This line will be a contact line with a terminal tip such as a blade when the blade is inserted into the receptacle 10, and will be located where the curvature of spring arm 44 is tangent to, and contacts, the surface of the blade. This line of tangency 74 forms a third line of electrical contact between the receptacle 10 and the blade, and lies generally between the contact lines represented by ribs 68 and 70.

A hood 80 is provided to protect the spring arms 44 and 46 and to guide a blade or other terminal tip into the receptacle aperture 60. This hood, which preferably is generally rectangular in cross section as illustrated in FIG. 6, fits over the body portion 34 of receptacle 10 and snugly engages the outer surfaces of its walls, as at 82. The hood 80 extends forwardly and at the beginning of the spring arms 44 and 46, tapers generally inwardly at 84, and then extends parallel to and coaxial with the axis 50, as illustrated at 86, to terminate in a forward-facing aperture 88 which is aligned with and surrounds receptacle aperture 60. The hood 80 thus surrounds and encloses the spring arms 44 and 46 (FIG. 3), with the free ends 71 and 72 of the arms engaging the interior surface of the wall of the hood in region 86 to preload the spring arms inwardly, as illustrated in FIG. 3. The dimensions of the forward portion 86 of the hood are selected to squeeze the spring arms 44 and 46 toward each other by an amount sufficient to reduce the distance d between them (FIG. 3) to a size slightly smaller than the anticipated thickness of the blade or other elongated tip to be received by receptacle 10. This inward pressure at the end 71 of arm 46 causes the thinned central region 56 to tend to bow slightly, producing a tendancy for the central region to assume a convex curvature to insure a tight fit and good electrical contact between the connector components. When a blade or other terminal tip is inserted into the receptacle, the tip engages the ribs 68 and 70 to force them outwardly with respect to the axis 50. Since the hinge 64 and the free end 71 of the arm 46 are fixed by the connection to the wall 42 and the contact with the hood 80, respectively, the outward pressure on the ribs causes the central region 56 to flex and to bow outwardly. The resulting concavity of the central region acts as a spring to urge the ribs inwardly against the termina. As a result, the lines of contact at 68 and 70 on spring arm 46 and the line at 74 on spring arm 44 will firmly engage the opposite sides of the blade.

The hood 80 is secured in place on the body portion 34 by crimps 90 which engage corresponding indentations 92 at the corners of the body portion 34. The indentations may be preformed or may be formed during the crimping operation.

To prevent overstressing and deformation of the spring arms 44 and 46, the hood 80 incorporates a pair of indentations or inwardly lanced tabs indicated at 93 and 94 (FIG. 5) in the region of the central portion 56 of the spring arms. The tabs 93 and 94 are located outside the spring arms and prevent excessive outward motion away from axis 50 when a terminal blade or other tip of the wrong size or shape is inserted into the aperture 60. The tabs also provide backing for the spring arms to prevent excessive bending when a tip is inserted at an angle with respect to the central axis 50, to thereby deflect the tip back toward axial alignment. The tabs 93 and 94 and their relationship to the spring arms 44 and 46 are illustrated in the enlarged view of FIG. 5.

It will be noted that the free ends of the arms 44 and 46 are turned inwardly at 71 and 72 to more easily accommodate assembly of the hood 80 onto the terminal. Further, the end of the hood adjacent aperture 88 includes inwardly turned flanges 96 and 98 to facilitate insertion of a terminal blade, as illustrated in greater detail in the enlarged partial perspective view of FIG. 6. As there illustrated, the hood 80 may be approximately square in cross section, with the inturned flanges 96 and 98 cooperating with the spring arms 44 and 46 to provide a generally rectangular aperture 88 sized to receive the blade, and leading to the interior aperture 60 between the spring arms.

FIGS. 7–9 illustrate a typical blade-type terminal 100 which includes first and second crimping portions 102 and 104 precision formed from a sheet metal body portion 106. The first crimping portion 102 at the rearward-most portion of the terminal is adapted to be crimped onto the insulating cover of a connector wire or cable (not shown), while the second crimping portion 104 is adapted to be crimped onto the bare wire strands of the cable for electrical connection thereto. A forward portion of the body is formed in a generally cylindrical shape, as at 107 and 108, with a distal end of the sheet metal body portion 106 being folded back on itself to form a double-walled head portion 110 (see FIG. 9) having a rearwardly facing annular edge 112 which may be used to lock the terminal 100 into a connector of the type illustrated in U.S. Pat. No. 5,295,875, for example.

As described above with respect to the receptacle 10 of FIG. 1, the body portion of terminal 100 is fabricated from a flat metal stamping which is precision formed into the illustrated generally cylindrical form, with the outer edges of the stamping being folded upwardly to form the crimping portions 102 and 104 and with the opposite edges of the forward portions 107, 108, and 110 being drawn together at joint 114 so that they are formed around and tightly crimped onto the outer surface of a solid metal terminal tip such as a pin or a blade 120 so that the blade is secured at one end in the body portion 106. The precision forming process permits the head portion 110 to be formed by folding back the distal end of the metal as the metal is formed around blade 120.

Blade 120 may be fabricated from solid wire stock which, after being crimped in the sheet metal body portion 106 of the terminal, is flattened at its forward end, as by coining, to produce a blade having narrow top and bottom surfaces 122 and 123 and broad, flat side surfaces 124 and 125, as illustrated in FIGS. 7 and 8. The thickness t of the blade, illustrated in FIG. 7, preferably is slightly greater than the distance d between the spring arms 44 and 46 of the receptacle 10 after the hood is in place, as illustrated in FIG. 3, so that upon insertion of blade 120 into the receptacle 10, a firm, positive electrical contact will be made between the contact lines 68, 70, and 74 and the flat, wide surfaces 124 and 125 of the blade 120. FIG. 5 illustrates in an enlarged view the relationship between blade 120 and the contact lines when the blade is inserted into the receptacle.

A variation of the spring arm configuration of the present invention is illustrated in FIGS. 10 and 11, wherein elements similar to FIG. 1 are similarly numbered. In the embodiment of FIG. 10, the spring arm 44 of FIG. 1 is replaced by spring arm 130 which is a mirror image of arm 46. Arm 130 includes transverse ridges 132 and 134 and a central region 136 between ridges 132 and 134. The region 136 is thinned to provide a flexible spring action, together with the hinge region 64 as described with respect to FIG. 1. The spring action provides uniform, firm pressure along contact lines 132 and 134 on a surface of a terminal blade such as the blade 120, the two spring arms 46 and 130 thus providing four lines of contact. It will be understood that the embodiment of FIG. 10 may also incorporate an "anti-stress" hood, as illustrated at 140 in FIG. 11, with the hood incorporating indentations 142 to prevent the spring arms from being distorted, as described above with respect to tabs 93 and 94.

Another variation of the spring arm configuration of the invention is illustrated by a receptacle 150 in FIGS. 12 and 13. In this embodiment, spring arm 44 is replaced by a rigid support arm 152, which may be a part of the receptacle, as shown. The opposite spring arm 46 is the same as that described above with respect to FIG. 1, and serves to press a blade-type terminal against the rigid arm and to provide two transverse lines of contact on the terminal.

The rigid arm 152 may be omitted, if desired, and the receptacle 150 may be mounted in a connector (not shown) which will provide a non-conductive rigid support surface against which a terminal may be pressed by the spring arm 46. Various other configurations will be apparent to those of skill in the art.

Although the invention has been described with respect to a single receptacle and a single plug, or male terminal, it will be understood that multiple receptacles can be provided in a connector, adapted to receive multiple terminals, and that the receptacle can have various cross-sectional shapes and sizes for receiving corresponding terminal pins or blades.

Although the present invention has been described in terms of preferred embodiments, it will be understood that variations and modifications may be made without departing from the true spirit and scope thereof, as set forth in the following claims.

What is claimed is:

1. An electrical connector, comprising:

a plug-type terminal having an elongated contact tip; and a receptacle including a body portion having a longitudinal axis; and first and second spaced, opposed arms connected at respective first ends to said body portion and extending longitudinally from said body portion to respective free ends, said arms being located parallel to and on opposite sides of said axis to define a receptacle for said contact tip, at least said second arm being generally convex longitudinally and including a pair of transverse, spaced ribs defining first and second contact lines spaced along said axis for engaging a first surface of said elongated contact tip upon insertion of said contact tip into said receptacle, said first arm being convex and continuously curved in a plane extending from said body portion to its respective free end and including a third transverse contact line for engaging a second surface of said elongated contact tip upon insertion of said contact tip into said receptacle, said third contact line being located along said axis between said first and second contact lines.

2. The connector of claim 1, further including a hood secured to said body portion and surrounding said arms.

3. The connector of claim 2, wherein said hood includes a tab for limiting motion of one of said arms within said hood.

4. The connector of claim 3, wherein said arms define a rectangular receptacle, and wherein said hood includes a rectangular aperture axially aligned with said receptacle to guide an elongated contact tip into said receptacle.

5. The connector of claim 4, wherein the free ends of said arms are engaged by said hood to maintain electrical contact between said arms and said elongated contact tip at said contact lines.

6. The connector of claim 1, wherein said second arm is metal and is coined to produce a central portion between said first and second contact lines which is wider and thinner than the metal of the remainder of said arm.

7. The connector of claim 6, wherein said central portion has a greater flexibility than that of the remainder of said second arm.

8. The connector of claim 1, wherein said second arm is metal coined to produce an elongated, thin, flexible spring arm having a hinge connection to said body portion and having a central portion wider and thinner than said hinge connection or said free end, said central portion providing a concave spring for urging said first and second contact lines against said elongated contact tip.

9. An electrical receptacle, comprising a sheet metal body having crimping sections for receiving an electrical conductor, a forward body portion having a longitudinal axis, and unitary, forwardly extending first and second spring arms hingedly connected to said forward body portion, said second spring arm being shaped to include a first segment extending inwardly toward said axis, a second segment extending generally parallel with said axis, and a third segment extending generally outwardly from said axis, said segments being end-to-end and forming a generally convex resilient spring arm, said first and second segments joining at a first transverse contact rib and said second and third segments joining at a second transverse contact rib, said ribs being spaced along said axis to provide two transverse lines of contact with a terminal inserted in said receptacle, said second spring arm being thinner than the sheet metal forming said forward body portion to provide a flexible, resilient contact arm; said first spring arm being convex and continuously curved from said body portion to its respective free end and including a third line of contact with the inserted terminal.

10. The connector of claim 9, further including a convex curved second arm extending from said body portion to a free end parallel to said strong arm, wherein said second arm includes a third transverse contact line for engaging a second surface of a terminal upon insertion of the terminal into said receptacle, said third contact line being located along said axis between said first and second transverse contact ribs.

11. The connector of claim 10, wherein said second arm is metal, coined to have a reduced thickness, and is precision formed to produce a continuous curve.

12. The connector of claim 10, wherein said second arm includes a pair of transverse spaced ribs defining third and fourth contact lines for engaging a second surface of said contact.

13. The connector of claim 12, wherein said second arm is metal coined to produce a central portion between said third and fourth contact lines having a thickness less than the remainder of said first arm and being wider at said central portion than at said hinge or said free end.

14. The receptacle of claim 9, wherein said central portion has a transverse width greater than the width of said first and third segments.

15. The receptacle of claim 14, wherein said central portion is responsive to deflection to bow outwardly to form a convex region between said first and second ribs.

16. An electrical connector, comprising:

a plug-type terminal having an elongated contact tip; and a receptacle including a body portion having a longitudinal axis; and first and second spaced, opposed arms connected at respective first ends to said body portion and extending longitudinally from said body portion to respective free ends, said arms being located parallel to and on opposite sides of said axis to define a receptacle for said contact tip, at least said second arm being generally convex longitudinally and including a pair of transverse, spaced ribs defining first and second contact lines spaced along said axis for engaging a first surface of said elongated contact tip upon insertion of said contact tip into said receptacle, said first arm being generally convex and including a pair of transverse ribs defining third and fourth contact lines spaced along said axis for engaging a second surface of said elongated contact tip upon insertion of said contact tip into said receptacle.

* * * * *

UNITED STATES PATENT AND TRADEMARK OFFICE

CERTIFICATE OF CORRECTION

PATENT NO. : 5,462,459

DATED : October 31, 1995

INVENTOR(S) : CHILDS, Jonathan

It is certified that error appears in the above-indentified patent and that said Letters Patent is hereby corrected as shown below:

Column 10, line 17, the word "strong" should be --spring--.

Signed and Sealed this

Twenty-sixth Day of December, 1995

*Attest:*

Bruce Lehman

BRUCE LEHMAN

*Attesting Officer*

*Commissioner of Patents and Trademarks*